US006116116A

United States Patent [19]

Brucart Puig et al.

[11] Patent Number: 6,116,116

[45] Date of Patent: Sep. 12, 2000

[54] CORKSCREW WITH RIBBED ARM

[76] Inventors: Ramón Brucart Puig; Marta Bonich Linares, both of Gustavo Becquer, 105, 08206 Sabadell, Spain

[21] Appl. No.: 09/306,070

[22] Filed: May 6, 1999

[30] Foreign Application Priority Data

May 5, 1998 [ES] Spain ..... 9800947

[51] Int. Cl.[7] ..... B67B 7/62

[52] U.S. Cl. ..... 81/3.37; 81/3.09; 81/3.55

[58] Field of Search ..... 81/3.45, 3.55, 81/3.47, 3.09, 3.35, 3.36, 3.37; 7/155

[56] References Cited

U.S. PATENT DOCUMENTS

| | | | |
|---|---|---|---|
| 786,492 | 4/1905 | Garimaldi | 81/3.37 |
| 1,110,210 | 9/1914 | Kissinger | 81/3.37 |
| 4,437,359 | 3/1984 | Dejoux et al. | 81/3.09 |
| 4,584,911 | 4/1986 | Cellini | 81/3.36 |
| 5,454,282 | 10/1995 | Del Mistro | 81/3.36 |

FOREIGN PATENT DOCUMENTS

| | | | |
|---|---|---|---|
| 571272 | 2/1933 | Germany | 81/3.37 |

*Primary Examiner*—David A. Scherbel
*Assistant Examiner*—Joni B. Danganan
*Attorney, Agent, or Firm*—Michael J. Striker

[57] ABSTRACT

An improved corkscrew having a main body or lever (1), whose intermediate section has a shaft (2) on which a helicoidal thread (3) swings and in whose end there is another shaft (7) by which a second ribbed arm (8) swings, having on its two sides two grooves (12) opposite to each other, along which the two extensions of the shaft (7) run, with several locking points.

9 Claims, 3 Drawing Sheets

CORKSCREW WITH RIBBED ARM

BACKGROUND OF THE INVENTION

The present invention refers to an improved corkscrew of the type used to remove cylindrical corks from glass bottles containing liquid and especially wine.

Corkscrews are well known, especially for being designed to remove cylindrical cork stoppers from bottles, basically consisting of a puller, whose pointed end penetrates the surface of the stopper to be removed and after manually penetrating the latter by applying pressure and rotating, it has an articulated extensible arm device, with a point of support for the bottle neck, after which significant physical force has to be applied to create the corresponding leverage to remove the bottle stopper in question, almost always leaving a piece of cork inside the bottle, hence requiring an extra effort to complete the operation.

This second pulling operation, causes the bottle to shake due to the resulting back motion of said action, which may provoke undesired spillage of the bottle contents.

SUMMARY OF THE INVENTION

The improved corkscrew proposed by the invention has been conceived and structured to solve the aforementioned problems, since the cylindrical stopper is removed from the bottle continuously and without unnecessary force since it incorporates a device acting as a ratchet, permitting removal, always applying the same pressure or force, such that the stopper is extracted smoothly and without abrupt movements, hence eliminating any possibility of shaking or spilling the contents of the bottle.

The pressure applied to the lever divides the run thereof into several stages, each one of which represents a degree of opening thereof, significantly less than the pressure that should be applied when executing a single run, since the lever rises and descends twice in each direction, equally distributing the total force.

The most important characteristic of this improved corkscrew is that it is provided with a ribbed, foldable arm of the main body or lever, which at its end has a crimp which should lean over the upper edge of the bottle mouth with the stopper to be removed, such that the shaft on which the lever swings is located at the beginning in the more or less intermediate part of the arm and as the levering action is applied to remove the stopper, a spring located for such a purpose makes the shaft, in the manner of a ratchet, situate itself at different heights with respect to the support arm.

This system permits the removal of the stopper in question with the minimum effort and without the former rubbing with the lower part of the extractor arm.

BRIEF DESCRIPTION OF THE DRAWINGS

To complete the description being made and to better understand the features of the invention, a set of drawings is attached to this specification where the following is shown to illustrate the former without limiting its extension.

PREFERRED EMBODIMENT OF THE INVENTION

Figure 1:
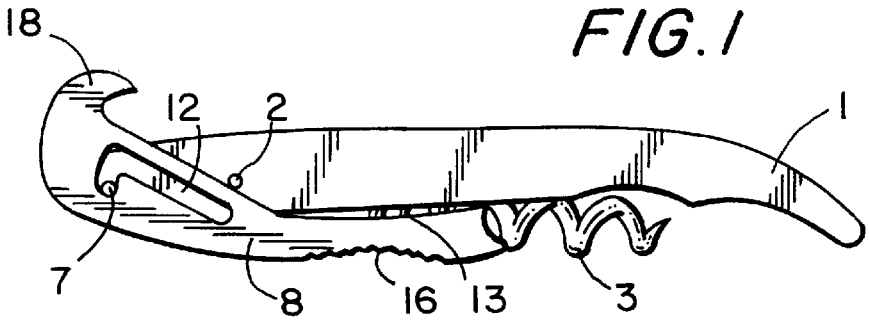
FIG. 1—shows a view of the improved corkscrew in the folded position.

In the light of these figures it may be seen how the structure of this improved corkscrew is formed as from a first ergonomic arm or lever (1) having in its middle part a shaft (2) from which a helicoidal thread or puller (3) is fastened at its square end (4) and whose other end finishes in the shape of a punch (5). Inside this main body or lever (1), a spring (6) is interlocked.

At one of its ends, this main body (1) has a shaft (7) by means of which another ribbed arm swings in its inner part (8), the former having a spring (9) which is fastened at one of its ends in the intermediate section (10) of this ribbed arm (8), leans in the intermediate section on the shaft (7) supporting the main arm (1), and is fastened in its other end to the main arm of lever 1.

On its opposite faces, the ribbed arm (8), has some grooves (12) also opposite to each other and symmetrical in the entire run, along which the ends of the shaft (7) located in the main body (1) run.

The spring (9) applies a double function to the device, since in the rest state or closure of the improved corkscrew (FIG. 1), it pulls the two arms (1) and (8) for them to maintain a parallel arrangement and in a working position it applies a slight but sufficient pressure for it to continue next to the helicoidal thread or puller (3).

The ribbed arm (8), may have, on at least one of its sides, a sharp finish (13), serving to unseal the bottle capsules or seals. It may also have the main arm or lever (1), with a groove in which a pen-knife may be located for the same purpose.

Figure 2:
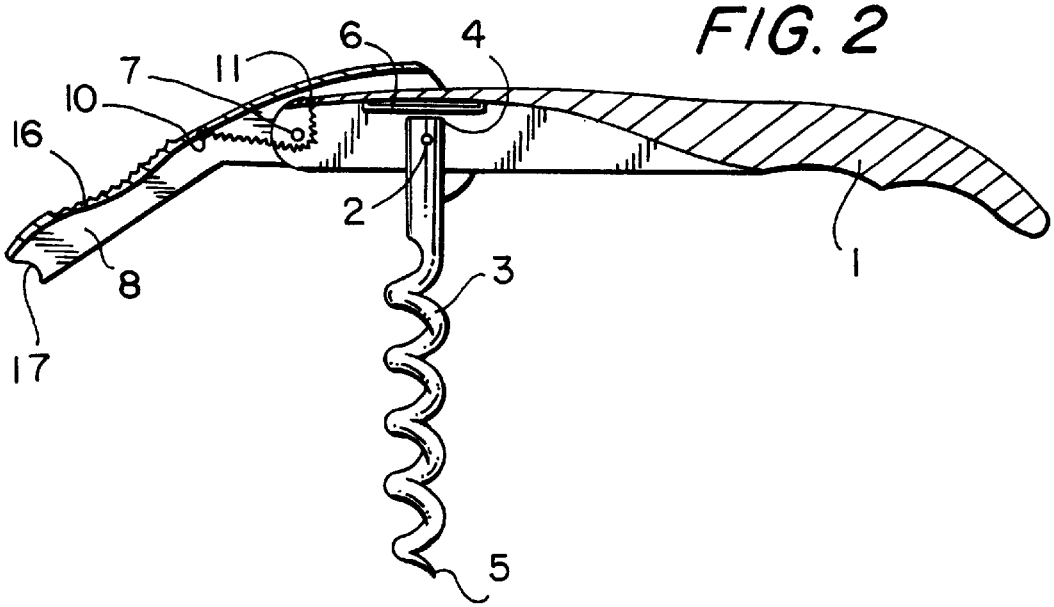
FIG. 2, shows a section of the improved corkscrew in the unfolded position.
Figure 3:
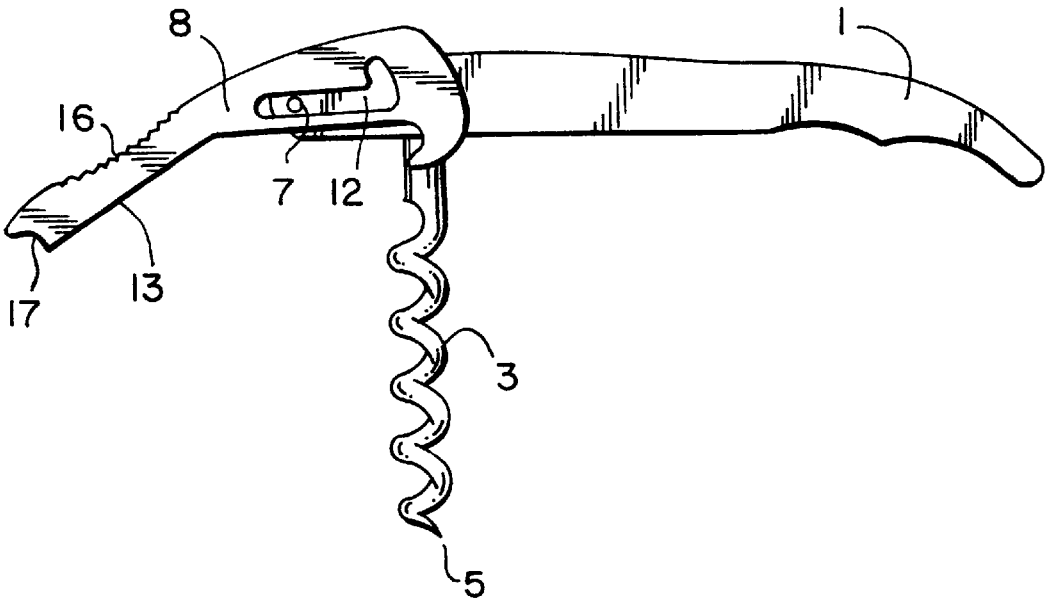
FIG. 3, shows the improved corkscrew in the unfolded position.
Figure 4:
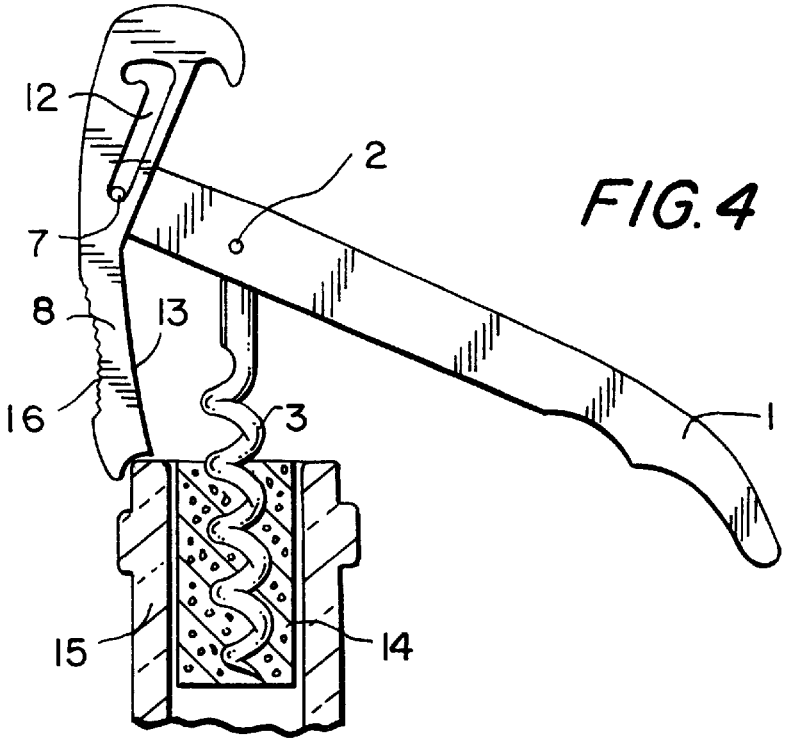
FIG. 4, shows a perspective view in which the foldable arm may be seen, with its end leaning on the upper part of the bottle mouth and the lever significantly lowered to be immediately raised.
Figure 5:
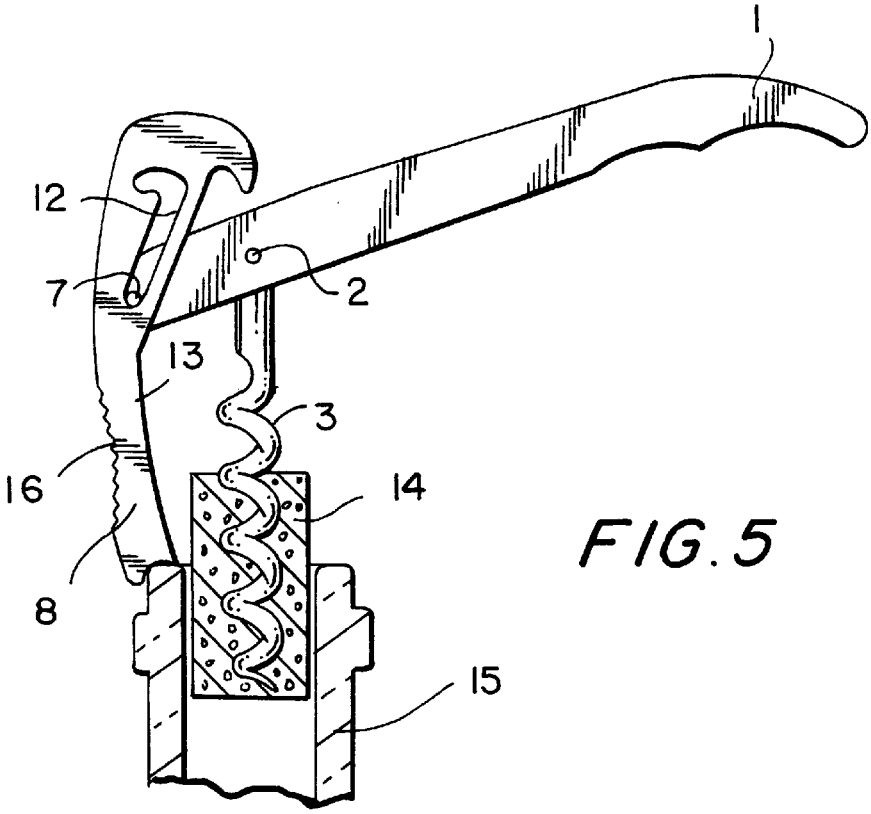
FIG. 5, shows a perspective view of the improved corkscrew once the lever has been raised the first time.
Figure 6:
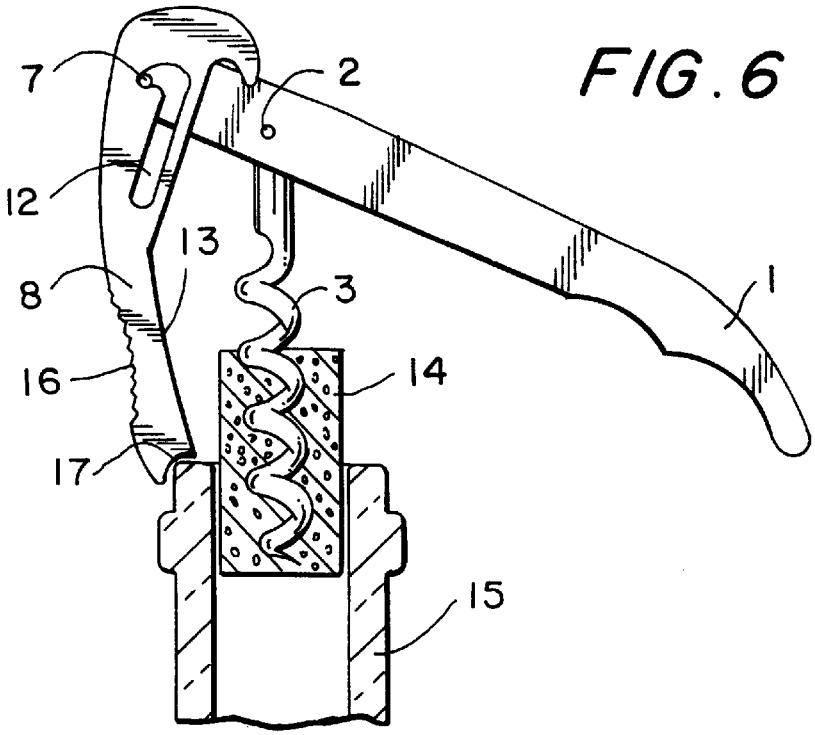
FIG. 6, shows a perspective view of the improved corkscrew with the shaft leaning on the second ratchet point and with the extracting lever in a downwards position prepared for lifting.
Figure 7:
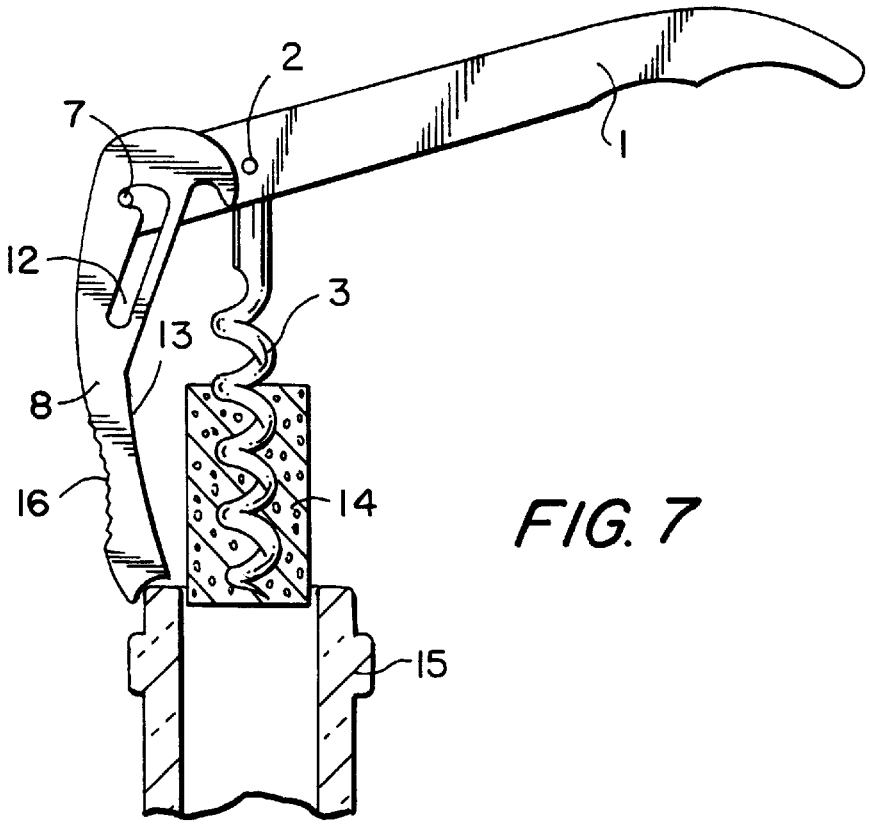
FIG. 7, shows a perspective view of the improved corkscrew once the lever has been raised.

The starting point for use is the folded position of the improved corkscrew as shown in FIG. 1. Then open the ribbed arm (8) until it adopts the position shown in FIG. 2, that is, rotating it about one hundred and eighty degrees, whose position remains stable due to the force applied by the spring (9) tending to join the two components.

Then, the helicoidal thread or puller (3) should be folded about ninety degrees, such that the spring (6) existing in the main body for such a purpose pushes against it, facilitating its penetration in the stopper (14) of the bottle (15) to be removed.

Once the puller (3) has been introduced, a slight pressure should be applied on the outside part (16) of the ribbed arm (8), making the spring (9) to aid the latter to suitably locate itself, that is, the convex termination (17) of the foldable arm (8) should be placed on the upper part of the bottle (15) neck.

After this positioning, the lever or main body (1) will be activated upwards, the latter swinging from the ribbed arm (8), by means of the shaft (7) locked in the lower position and once this main arm (1) is raised, it should be lowered until the shaft (7) slides towards the other upper locking point by means of the guide (12), then repeating the action, that is, raising the main arm (1) until the stopper (14) is totally removed.

It should be mentioned that the grooves (12) may have as many shaft (7) support points as necessary.

The ribbed arm (8) may have two extensions in the shape of a hook (18) to extract crown stoppers.

It is not considered necessary to extend this description for any expert in the matter not to understand the scope of the invention and the advantages derived from it.

The materials, shape, size and arrangement of the components will be susceptible to variation, provided they do not change the scope of the invention.

The terms in which this report has been drafted should always be interpreted widely and without limitations.

What is claimed is:

1. A corkscrew, comprising a main body; a helicoidal thread; a fastening shaft which foldably connects said helicoidal thread with said main body; another shaft provided at an end of said main body; a ribbed arm arranged swingably relative to said main body on said another shaft and serving as a support point to a bottle neck; and a spring having one end fastened to an end part of said main body, an intermediate portion leaning over said another shaft and another end connected with said ribbed arm substantially in a middle of said ribbed arm, so that said spring causes, according to an open or a closed position of the corkscrew, a slight pressure so that both said positions are locked.

2. A corkscrew as defined in claim 1, wherein said ribbed arm is provided with grooves while said another shaft has extensions sliding along said grooves.

3. A sensor as defined in claim 2, wherein said grooves of said ribbed arm are formed so that said extensions of said another shaft remain locked in at least two positions.

4. A sensor as defined in claim 2, wherein said grooves have at least one notch to couple an extension of said another shaft.

5. A sensor as defined in claim 1, wherein said spring in said open position causes a coupling of said main body with said ribbed arm.

6. A sensor as defined in claim 1, wherein said spring in a working position makes said ribbed arm tend to press toward said helicoidal thread.

7. A sensor as defined in claim 1, wherein said ribbed arm has a front part provided with a rough surface for facilitating a grip of fingers to activate it.

8. A sensor as defined in claim 1, wherein said ribbed arm has at least one side finishing with an edge which is sharp to unseal capsules or seals.

9. A sensor as defined in claim 1, wherein said ribbed arm has two extensions shaped as a hook for removal of crown stoppers.

* * * * *